US005876141A

United States Patent [19]

Hsu

[11] Patent Number: 5,876,141

[45] Date of Patent: Mar. 2, 1999

[54] MOP WITH MULTI-DIRECTIONAL HEAD

[76] Inventor: Hsing-Yuan Hsu, No.274, Lane 125, Sec. 3, Yuan Jyi Rd., Tien Chung Town, Chang Hua Hsien, Taiwan

[21] Appl. No.: 867,795

[22] Filed: Jun. 3, 1997

[30] Foreign Application Priority Data

Nov. 21, 1996 [TW] Taiwan ..... 85217986

[51] Int. Cl.[6] ..... B43K 8/12

[52] U.S. Cl. ..... 401/207; 401/768; 15/147.1; 15/144.2

[58] Field of Search ..... 401/207, 268; 15/144.1, 144.2, 147.1, 150, 146, 148

[56] References Cited

U.S. PATENT DOCUMENTS 3,362,037 1/1968 Griffin ..... 15/144.1

3,778,860 12/1973 Thielen ..... 15/144.2

4,763,377 8/1988 Madsen ..... 15/144.2

4,885,876 12/1989 Henke ..... 15/144.2

*Primary Examiner*—David J. Walczak

*Attorney, Agent, or Firm*—Bacon & Thomas

[57] ABSTRACT

A mop head is secured to a mop handle through a positioning block, directional block and connecting rod, whereby the connecting rod is pivotal relative to the directional block along the longitudinal axis of the head and pivotal with the directional block relative to the positioning block along the transverse axis of the head to provide multidirectional dispositioning of the handle relative to the head for accessing different surfaces to be cleaned.

1 Claim, 5 Drawing Sheets

MOP WITH MULTI-DIRECTIONAL HEAD

FIELD OF THE INVENTION

The present invention relates to a mop and, more particularly, to a mop having a multi-directional mechanism. The mop body has a circular recess in the top central portion. A pair of retaining lugs are extended upward from the recess. Each of the retaining lugs is provided with a U-shape retaining groove in the inner wall and those retaining grooves are opposed to each other. A positioning block can be disposed within the retaining grooves and the bottom of the positioning block is in touch with the circular recess. The positioning block has a curved surface at each of the longitudinal end surfaces and the top and bottom surfaces. A longitudinal rib portion is disposed at the top and which can be engaged with a ribbed portion of a directional block when the latter is disposed above the positioning block. The directional block has a through hole at top which communicates with a through hole of the forked connecting rod. A bolt which passes through those holes and a nut can be applied to fix the forked portion and the directional block. By the relative movement between the forked connecting rod and the directional block and the directional block and the positioning block, a different angular arrangement between the main rod and the mop body can be attained such that the mop body can be readily manipulated to clean the floor.

DESCRIPTION OF THE ART

There are many types of mops available in the market. In the simplest one, the mop comprises an elongate rod and a cluster of cloth scraps or strings fastened together at one end. In application, the scraps cluster can be wetted in water and then applied to clean the floor. However, the scraps or strings cluster have a certain diameter which cannot be readily held by hand, especially when the scraps cluster is wetted by water. If excess water is deployed onto the floor by the wetted mop, the floor will become very slippery and people may fall on the slippery floor. On the other hand, the fibers of the cluster become shelter for the debris from the floor. Once the debris is engaged and embraced by the scraps or strings, it is hard or even impossible to remove the debris therefrom. Furthermore, the wetted mop is difficult to be dried completely and undesired odor is generated after a period of time. Besides, as limited by the configuration of the conventional mop, it can only be applied to clean the wall surface and corner.

In order to solve the problems encountered by the conventional mop, a mop made from foam material is provided. However, the foam material will become aged, such as hardening, cracking, after a period of usage. Once the foam material is aged, it shall be discarded and the user need to buy another new one. Furthermore, this foam material mop can only be used to clean the floor and can not be used for other applications. Since none of the conventional mops can meet all the requirements of the user, therefore, the user can only select a merely suitable one by try and error. Accordingly, each user may have many mops. However, with their poor cleaning function, many have been discarded.

Recently, a flat-mop has been introduced to the market and which has been widely accepted since it has a superior function over the conventional mop. The flat-type mop includes a stick and a planar plate having a cleaning cloth removably attached at the underside. The planar plate is rotationally attached to one end of the hand by a joint and socket assembly. Since the joint and the socket can not be relatively positioned with each other, the user may find it difficult to locate a point for exerting force to the planar plate. Accordingly, the direction of the planar plate can not be readily manipulated by the stick through the joint and socket assembly. As the planar plate can not be suitably manipulated, the planar plate may even be turned up side down.

SUMMARY OF THE INVENTION

It is the objective of this invention to provide a mop having a multi-directional mechanism wherein the mop body can be readily manipulated by the rod such that the user may clean as he/she wishes.

In order to achieve the object set forth, a mop having a multi-directional mechanism includes a main rod, a fork connecting rod, a directional block, and a positioning block. The mop head has a circular recess in the top central portion. A pair of retaining lugs are extended upward from the recess. Each of the retaining lugs is provided with a U-shape retaining groove in the inner wall and those retaining grooves are opposed to each other. A positioning block can be disposed within the retaining grooves and the bottom of the positioning block is in touch with the circular recess. The positioning block has a curved surface at each of the longitudinal end surfaces and the top and bottom surfaces. A longitudinal rib portion is disposed at the top and which can be engaged with a ribbed portion of a directional block when the latter is disposed above the positioning block. The directional block has a through hole at the top which communicates with a through hole of the forked connecting rod. A bolt passes through those holes and a nut can be applied to fix the forked portion and the directional block. By the relative movement between the forked connecting rod and the directional block and the directional block and the positioning block, a different angular arrangement (approximating 180 degrees both on longitudinal and traverse directions of the mop body) between the main rod and the mop body can be attained such that the mop body can be readily manipulated to clean the floor.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
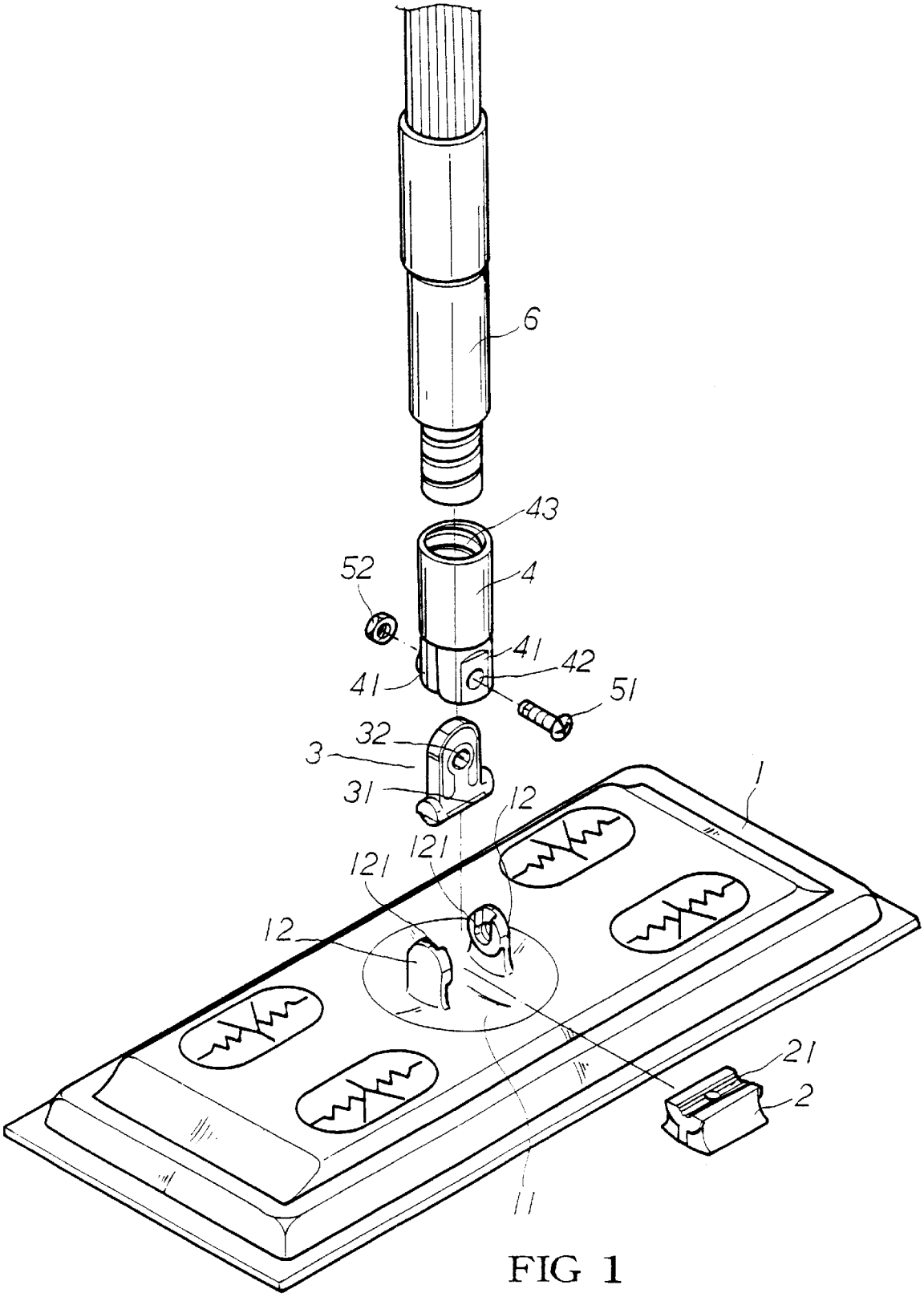
FIG. 1 is an exploded perspective view of the multi-directional mechanism made according to the present invention.
Figure 2:
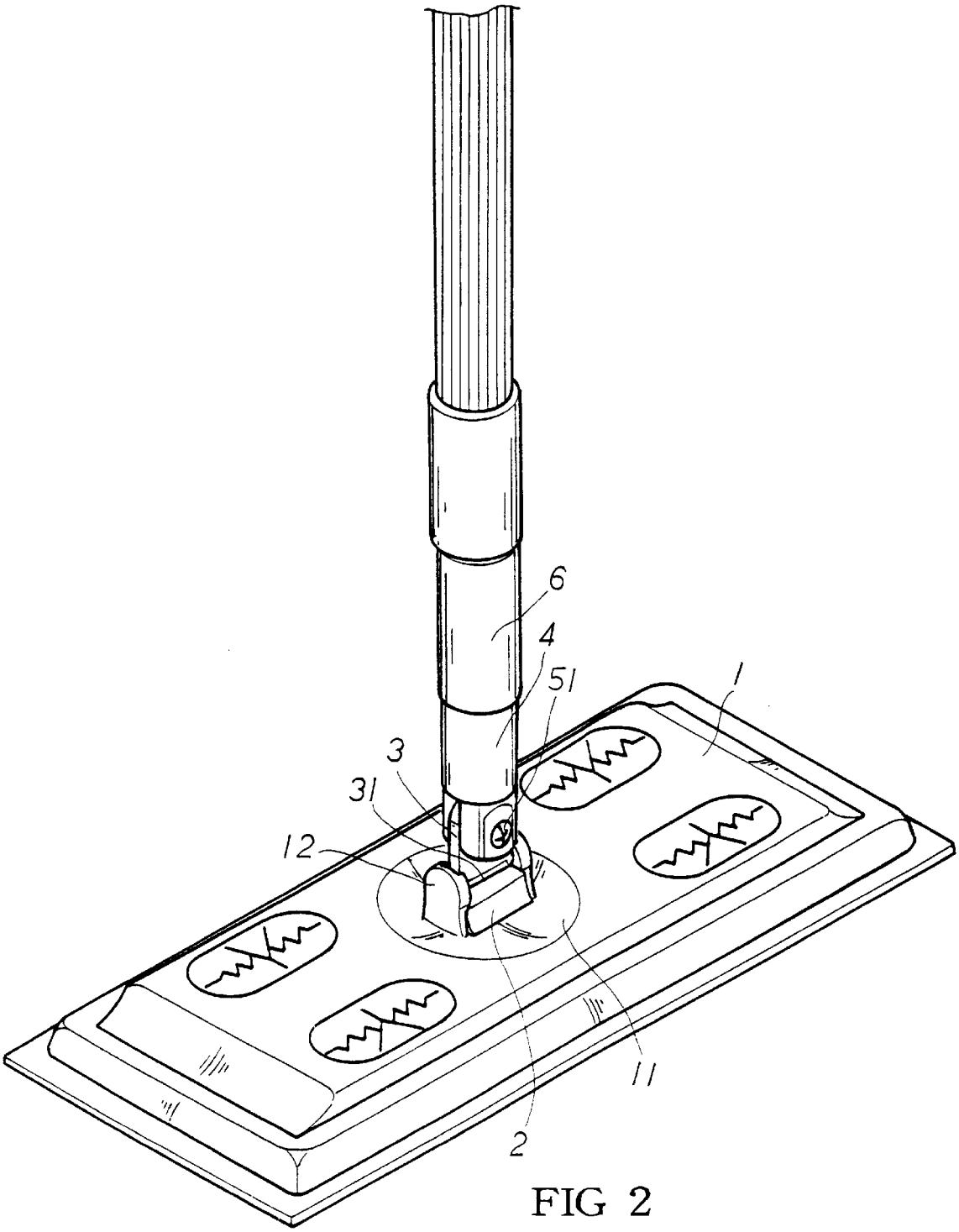
FIG. 2 is a perspective assembled view of the multi-directional mechanism shown in FIG. 1.

Referring to FIGS. 1 and 2, the mop having a multi-directional mechanism according to the invention includes a main handle, a fork connecting rod, a directional block, a positioning block and the mop head.

The mop head 1 which has a planar configuration includes a circular recess 11 in the central top portion. A pair of retaining lugs 12 are extended upward from the recess 11. Each of the retaining lugs 12 is provided with a U-shape retaining groove 121 in the inner wall and those retaining grooves 121 are opposed to each other. A positioning block 2 has its end portions disposed between and secured within the retaining grooves 121 in a stationary manner and the bottom of the positioning block 2 is in touch with the circular recess 11.

The positioning block 2 has a curved surface at each of the longitudinal end surfaces and the top and bottom surfaces. A longitudinal ribbed portion 21 is disposed on top and which can be engaged by a ribbed portion 31 of a directional block 3 when the latter is disposed above the positioning block 2 and has its opposite ends rotatably secured within retaining grooves 121.

The directional block 3 has a through hole 32 at top which communicates with a through hole 42 of the fork connecting rod 4, and the bottom of the directional block 3 is also provided with a longitudinal ribbed portion 31 which may engage with the ribbed portion 21 of the positioning block 2.

The forked connecting rod 4 has forked portion 41 at its front end. The fork portion 41 is provided with a through hole 42. In assembling, the directional block 3 is firstly disposed within the forked portion 41 such that the through holes 42 are aligned with the through hole 32 of the directional block 3. A bolt 51 passes through holes 42, 32 and a nut 52 can be applied to fix the fork portions 42 and the directional block 3. The top of the fork connecting rod 4 is provided with a threaded recess 43 which can be engaged with one end of the main rod 6.

From the forgoing description, it can be readily understood that the directional block 3 can be tilted and positioned along the traverse direction of the mop head 1 by the interference engagement between the ribbed portion 31 of the movable directional block 3 and the ribbed portion 21 of the stationary positioning block 2. On the other hand, the fork connecting rod 4 can also be tilted with respect to the directional block 3 along the longitudinal direction of the mop head 1 about the central axis of the bolt 51 which passes through the through holes 42 and 32. In light of this, the mop head 1 can be readily manipulated by the main handle 6 as the latter can be readily tilted and positioned in different angular positions with respect to the mop head 1. Consequently, there are no dead corners in which the mop head 1 can not access. As a result, the dust and/or debris can be completely cleaned and removed by the mop head 1.

Figure 3:
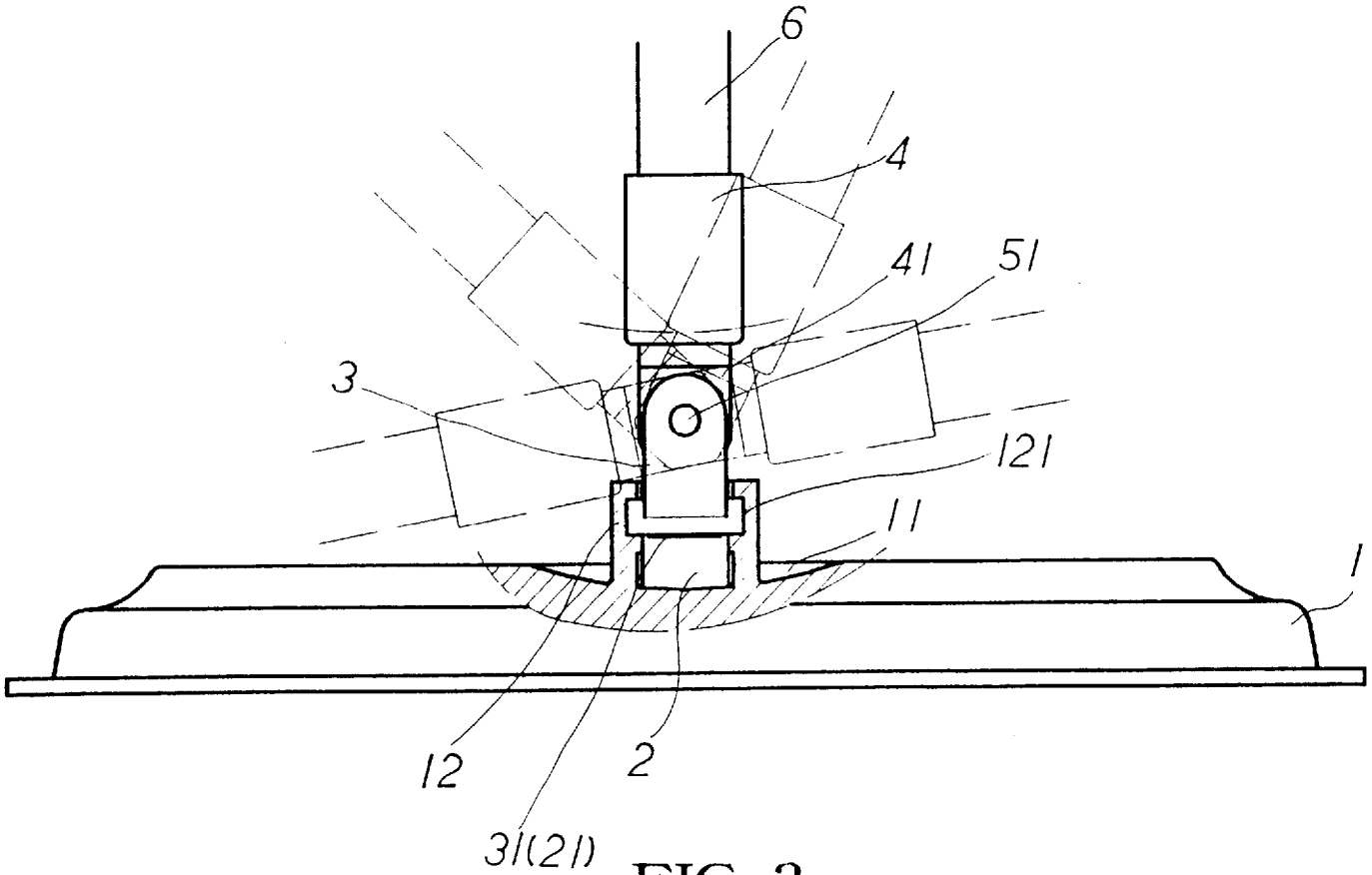
FIG. 3 is a schematic illustration of the multi-directional mechanism tilted along the longitudinal direction of the planar plate.
Figure 4:
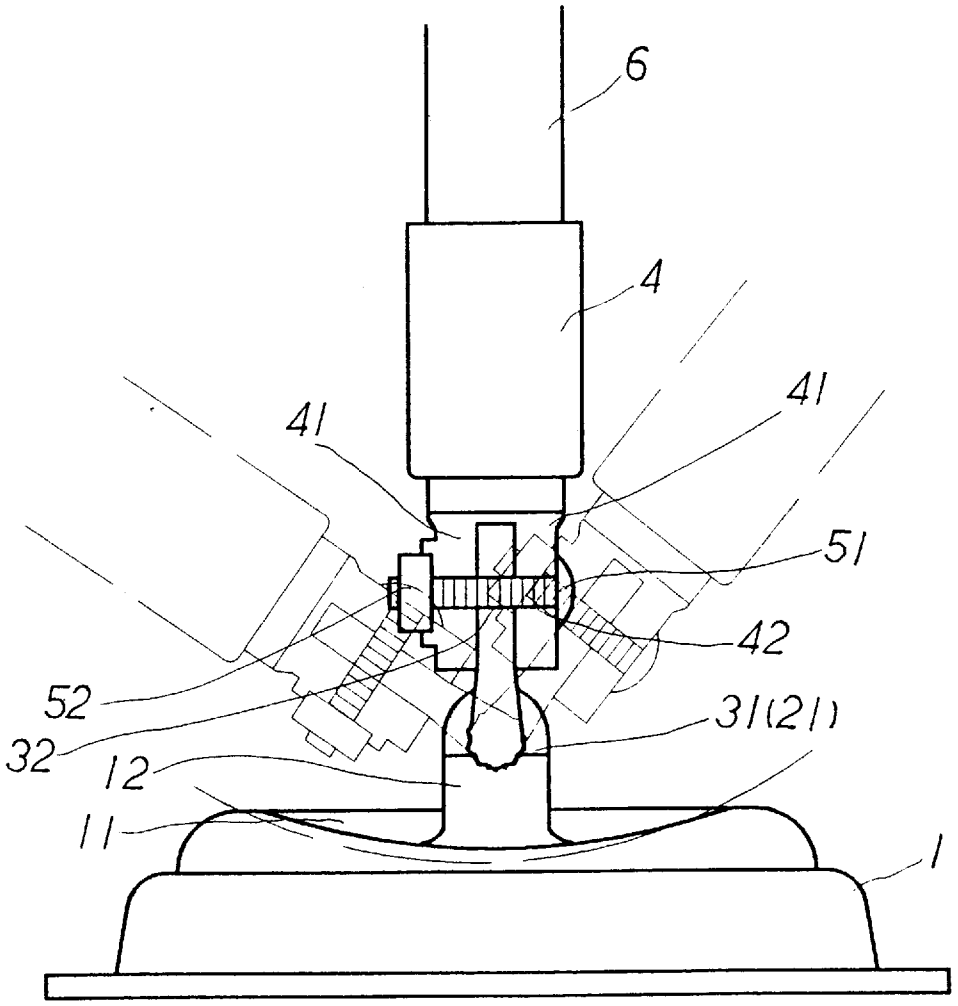
FIG. 4 is still a schematic illustration of the multi-directional mechanism tilted along the traverse direction of the planar plate.
Figure 5:
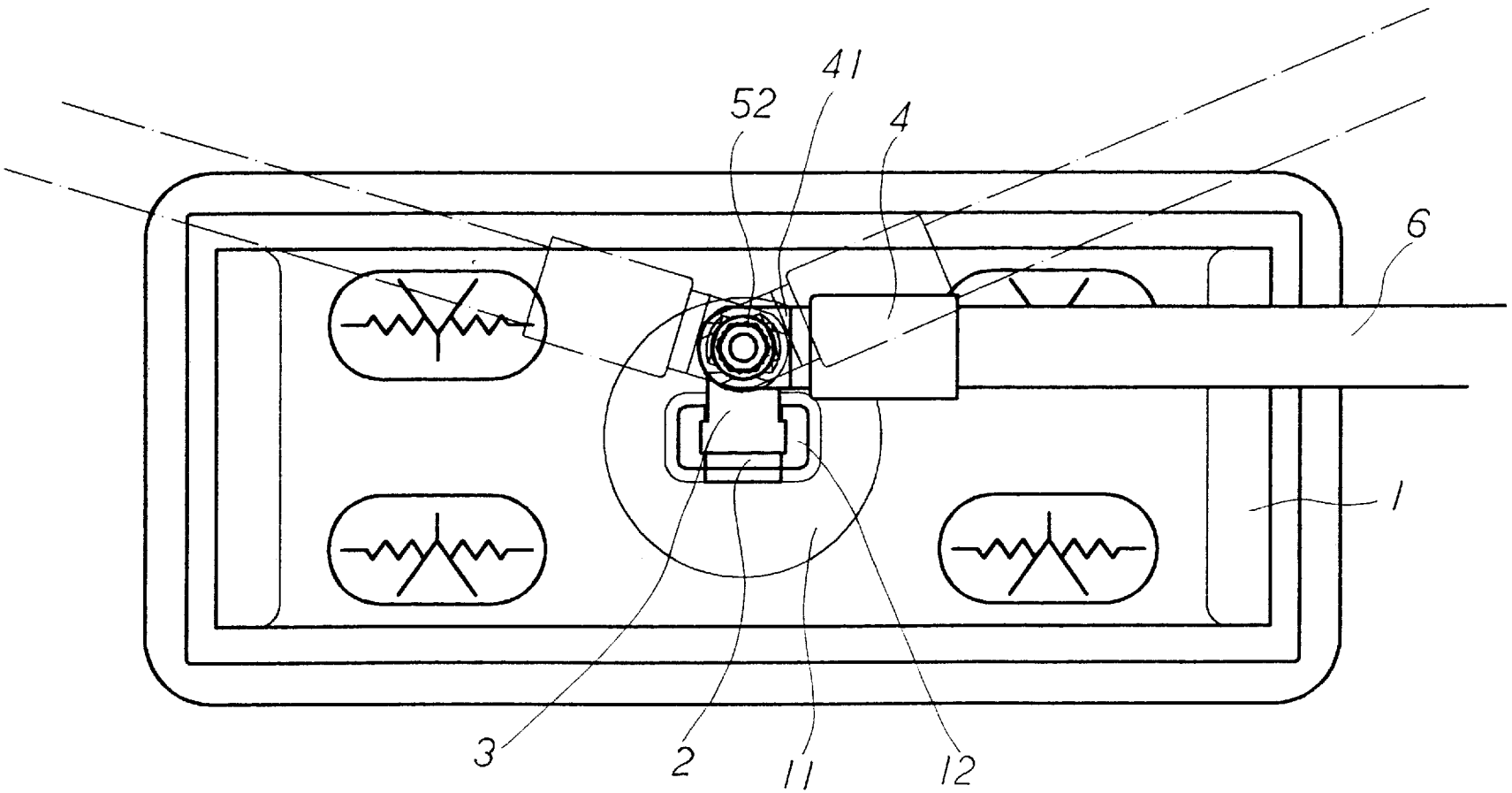
FIG. 5 is still a schematic illustration of the multi-directional mechanism beveled from the vertical axis perpendicular to the floor.

Referring to FIG. 3, in this situation, the positioning block 2 is stationary in a vertical position and the fork connecting rod 4 can be adjusted into different angles about the central axis of bolt 51. Referring to FIG. 4, the fork connecting rod 4 is kept stationary in a vertical plane with block 3, so a relative movement approximating 180 degrees can also be attained as centered on the bottom of the directional block 3 which is positioned with respect to the positioning block 2 by the engagement between the ribbed portion 21 of the positioning block 2 and the ribbed portion 31 of the directional block 3. By the interference engagement between the ribbed portion 21 of the positioning block 2 and the ribbed portion 31 of the directional block 3, the force applied from the main handle 6 can readily transferred to the mop head 1 such that the mop head 1 may have an excellent engagement with the floor and the mop body 1 can also be suitably manipulated. By the cooperation between the stationary positioning block 2 and the movable directional block 3, as shown in FIG. 5, different angular arrangement between the main handle 6 and the mop head 1 can be attained.

While a particular embodiment of the present invention has been illustrated and described, it will be obvious to those skilled in the art that various other changes and modifications can be made without departing from the spirit and scope of the invention. It is therefore intended to cover in the appended claims all such changes and modifications that are within the scope of the present invention.

I claim:

1. A mop with multidirectional head comprising:

a) a mop head including a circular recess at a top central portion thereof, a pair of spaced retaining lugs extending upwardly from the recess, each retaining lug being provided with a U-shaped retaining groove formed in an inner wall thereof, and the retaining grooves being opposed to each other;

b) a positioning block including a pair of curved longitudinal end surfaces, a curved top surface having a ribbed portion formed therein and a curved bottom surface, the positioning block being stationarily secured within the retaining grooves of the retaining lugs, and the bottom surface of the block being in engagement with the circular recess;

c) a directional block having a through hole formed at a top portion thereof and a bottom provided with a ribbed portion, the directional block being movably secured within the retaining grooves of the retaining lugs, and the ribbed portion of the directional block being disposed in an interference engagement with the ribbed portion of the positioning block;

d) a connecting rod having a first end deforming a forked portion, a pair of aligned holes extending through the forked portion, the top of the directional block being engaged within the forked portion and a fastener extending through the holes of the forked portion and the through hole of the directional block for pivotally securing the connecting rod to the directional block, and the connecting rod including a second end having a threaded recess formed therein; and e) a mop handle having a threaded end engaged within the threaded recess of the connecting rod.

* * * * *